US011667420B2

(12) United States Patent
Mader et al.

(10) Patent No.: US 11,667,420 B2
(45) Date of Patent: Jun. 6, 2023

(54) TRAY SEALER

(71) Applicant: Multivac Sepp Haggenmüller SE & Co. KG, Wolfertschwenden (DE)

(72) Inventors: Andreas Mader, Ottobeuren (DE); Wolfgang Negele, Bad Grönenbach (DE); Christoph Wagner, Bad Grönenbach (DE)

(73) Assignee: MULTIVAC SEPP HAGGENMÜLLER SE & CO. KG, Wolfertschwenden (DE)

( * ) Notice: Subject to any disclaimer, the term of this patent is extended or adjusted under 35 U.S.C. 154(b) by 568 days.

(21) Appl. No.: 16/816,587

(22) Filed: Mar. 12, 2020

(65) Prior Publication Data

US 2020/0207495 A1 Jul. 2, 2020

Related U.S. Application Data

(63) Continuation of application No. 15/255,027, filed on Sep. 1, 2016, now Pat. No. 10,661,932.

(30) Foreign Application Priority Data

Sep. 4, 2015 (EP) ..... 15183808

(51) Int. Cl.
*B65B 35/36* (2006.01)
*B65B 43/46* (2006.01)
(Continued)

(52) U.S. Cl.
CPC ..... *B65B 43/46* (2013.01); *B65B 7/162* (2013.01); *B65B 59/04* (2013.01); *B65B 61/005* (2013.01)

(58) Field of Classification Search
CPC ..... B65B 43/46; B65B 59/04
See application file for complete search history.

(56) References Cited

U.S. PATENT DOCUMENTS 4,175,734 A * 11/1979 Williams ..... B23K 37/0408 269/49
4,509,311 A * 4/1985 Hartl ..... B65B 61/28 53/477

(Continued)

FOREIGN PATENT DOCUMENTS

CN 101448706 A 6/2009
CN 103662663 B 11/2015

(Continued)

OTHER PUBLICATIONS

This image of a page from a manual of STAR2 supplied with the packaging machine 146 was included in an EU opposition proceeding regarding EU Patent No. EP3138778. European Patent No. EP3138788 is related to this U.S. Appl. No. 15/255,027. The opposition was filed on Oct. 3, 2018. This photograph, its date, and its contents have not been fully determined or authenticated as of the filing date of this IDS.

(Continued)

*Primary Examiner* — Praachi M Pathak
(74) *Attorney, Agent, or Firm* — Husch Blackwell LLP

(57) ABSTRACT

The invention relates to a tray sealer comprising a gripper device with two gripper arms, a supply device for unsealed trays, a removal device for sealed trays and a sealing device. Each gripper arm can comprise a coupling device that is configured to hold a first tray gripper for supplying trays into the sealing device and a second tray gripper for removing trays from the sealing device.

8 Claims, 3 Drawing Sheets

(51) Int. Cl.

| | |
|---|---|
| ***B65B 59/04*** | (2006.01) |
| ***B65B 59/00*** | (2006.01) |
| ***B65B 7/16*** | (2006.01) |
| *B65B 61/00* | (2006.01) |

(56) References Cited

U.S. PATENT DOCUMENTS

| | | | | |
|---|---|---|---|---|
| 4,974,392 | A * | 12/1990 | Mondini | B65B 7/164 53/329 |
| 5,475,965 | A * | 12/1995 | Mondini | B29C 66/876 53/329.3 |
| 8,240,353 | B2 * | 8/2012 | Vine | B65B 31/06 156/581 |
| 9,650,165 | B2 * | 5/2017 | Gabler | B65B 7/162 |
| 2004/0020174 | A1 * | 2/2004 | Couture | B65B 63/022 53/529 |
| 2009/0301658 | A1 | 12/2009 | Wine et al. | |
| 2012/0013138 | A1 * | 1/2012 | Ickert | B65B 43/46 294/24 |
| 2012/0187617 | A1 * | 7/2012 | Kuo | B25B 5/068 269/6 |
| 2014/0037402 | A1 | 2/2014 | Ickert et al. | |
| 2014/0069054 | A1 | 3/2014 | Gabler | |
| 2017/0066545 | A1 | 3/2017 | Mader et al. | |

FOREIGN PATENT DOCUMENTS

| | | | |
|---|---|---|---|
| DE | 102008030510 | A1 | 1/2010 |
| DE | 202009009242 | U1 | 12/2010 |
| DE | 102010027211 | A1 | 1/2012 |
| DE | 102012015401 | A1 | 2/2014 |
| EP | 680880 | A1 | 11/1995 |
| EP | 2275351 | A1 | 1/2011 |
| EP | 2692650 | A1 | 2/2014 |
| EP | 2706012 | A1 | 3/2014 |
| EP | 3138778 | A1 | 3/2017 |
| EP | 3138788 | A1 | 3/2017 |
| WO | 2011018391 | A1 | 2/2011 |

OTHER PUBLICATIONS

This image of a packaging machine 146 was included in an EU opposition proceeding regarding EU Patent No. EP3138778. European Patent No. EP3138788 is related to this U.S. Appl. No. 15/255,027. The opposition was filed on Oct. 3, 2018. This photograph, its date, and its contents have not been fully determined or authenticated as of the filing date of this IDS.

Photos of machine No. 697-135, 2 pages. EOa submitted by WilsonGunn to European Patent Office on Oct. 3, 2018 in Opposition against European Patent No. 3138778.

Photos of machine No. 697-146 and manual supplied with the machine, 4 pages. EOb/EOc submitted by WilsonGunn to European Patent Office on Oct. 3, 2018 in Opposition against European Patent No. 3138778.

Multiple transport hands group, Extract of manual of machine 146, 2 pages. E1 submitted by WilsonGunn to European Patent Office on Aug. 5, 2019 in Opposition against European Patent No. 3138778.

Photo of machine 146, 1 page. E2 submitted by WilsonGunn to European Patent Office on Aug. 5, 2019 in Opposition against European Patent No. 3138778.

Video showing machine 146, 1 page. E5 submitted by WilsonGunn to European Patent Office on Aug. 5, 2019 in Opposition against European Patent No. 3138778.

Annotated photo of machine 145, 1 page. E6 submitted by WilsonGunn to European Patent Office on Aug. 5, 2019 in Opposition against European Patent No. 3138778.

Photo of machine 145, 1 page. E7 submitted by WilsonGunn to European Patent Office on Aug. 5, 2019 in Opposition against European Patent No. 3138778.

Video showing machine 145, 1 page. E11 submitted by WilsonGunn to European Patent Office on Aug. 5, 2019 in Opposition against European Patent No. 3138778.

Witness Statement by K.S. Matharu, 1 page. E13 submitted by WilsonGunn to European Patent Office on Aug. 5, 2019 in Opposition against European Patent No. 3138778.

Translation of minutes of Shareholders' Meeting on Dec. 12, 2006, 7 pages. E14 submitted by WilsonGunn to European Patent Office on Jun. 16, 2020 in Opposition against European Patent No. 3138778.

Translation of minutes of Extraordinary Shareholders' Meeting on Dec. 23, 2011, 3 pages. E15 submitted by WilsonGunn to European Patent Office on Jun. 16, 2020 in Opposition against European Patent No. 3138778.

Translation of minutes of Shareholders' Meeting on Mar. 28, 2012, 9 pages. E16 submitted by WilsonGunn to European Patent Office on Jun. 16, 2020 in Opposition against European Patent No. 3138778.

Translation of minutes of Shareholders' Meeting on Jul. 20, 2012, 5 pages. E17 submitted by WilsonGunn to European Patent Office on Jun. 16, 2020 in Opposition against European Patent No. 3138778.

Second Witness Statement by K.S. Matharu, 11 pages. E18 submitted by WilsonGunn to European Patent Office on Mar. 26, 2021 in Opposition against European Patent No. 3138778.

CFS Palazzolo SPA STAR2HS Machine No. 697-178, https://www.youtube.com/watch?v=No. 8rEsbYtO0, 12 pages. E19 and E20 submitted by WilsonGunn to European Patent Office on Mar. 26, 2021 in Opposition against European Patent No. 3138778.

6-5: Tray sealing packaging machine, 4 pages, https://dfm-auctions.com/lot/lot-details/378/tray-sealing-packing-machine showing CFS Palazzolo SPA STAR2HS Machine No. 697-107 A. E21 submitted by WilsonGunn to European Patent Office on Mar. 26, 2021 in Opposition against European Patent No. 3138778.

CFS STAR 2HS Tray Sealing Machine in Labiszyn, Poland, 8 pages, https://www.machinio.com/listings/38821032-cfs-star-2hs-tray-sealing-machine-in-labiszyn-poland showing CFS Palazzolo SPA STAR2HS Machine. E22 and E23 submitted by WilsonGunn to European Patent Office on Mar. 26, 2021 in Opposition against European Patent No. 3138778.

Video of Multivac T 700 Tray Sealer, https://www.youtube.com/watch?v=6Vz8ZB-wvl, 2 pages A1, A2 and A3 submitted by WilsonGunn to European Patent Office on Apr. 6, 2022 in Opposition against European Patent No. 3138778.

* cited by examiner

TRAY SEALER

CROSS-REFERENCE TO RELATED APPLICATIONS

This application is a continuation of U.S. patent application Ser. No. 15/255,027 filed Sep. 1, 2016, currently pending, which claims priority to European Patent Application Number 15183808.3 filed Sep. 4, 2015, to Andreas Mader, et al., the entire disclosure of which is incorporated herein by reference.

FIELD OF THE INVENTION

The invention relates to a tray sealer.

BACKGROUND OF THE INVENTION

DE 10 2008 030 510 A1, DE 10 2010 027 211 A1, and DE 10 2012 015 401 A1 disclose tray sealers with tray grippers which are integrally configured and, during their movement in the direction of transport, convey several unsealed trays into a sealer. The tray grippers also convey trays sealed with a top film out of the sealer. Such tray sealers are equipped with sealing tools that, when viewed in the direction of production, become increasingly longer to further enhance the performance of these machines. The tray grippers also become correspondingly longer. With an extension of the sealing tool, for example, from 800 mm to 1100 mm, the tray gripper must, for example, be extended from 1600 mm to 2200 mm. Different tray grippers and sealing tools are commonly used for different tray shapes. Tray grippers and sealing tools, when not being used in a tray sealer, are mounted on tool trolleys which are frequently moved to special rooms outside the production area of the tray sealer for maintenance or for cleaning purposes. The length of the tray grippers can pose an obstacle when driving through a door.

The length of such tray grippers can also lead to problems in adjusting them to match the trays which are provided on a supply belt for being transferred, the trays in the sealing tool, and the trays which are deposited on a removal belt. Adjustment of the tray gripper becomes increasingly complicated with an increase in its length, especially with tray sealers in which the transport level of the supply belt, the removal belt and the depositing level on a sealing tool lower part form no common level.

SUMMARY OF THE INVENTION

One object of the present invention is to provide an improved tray sealer.

The tray sealer according to one embodiment of the present invention comprises a gripper device with two gripper arms, a supply device for unsealed trays, a removal device for sealed trays and a sealing device. Each gripper arm can comprise a coupling device that is configured to hold a first tray gripper for supplying trays into the sealing device and a second tray gripper for removing trays from the sealing device. Due to a separation of the two gripper arms, which are intended for different functions and are in different spatial workspaces, the length as compared to prior art tray grippers is approximately halved so that tool lengths above 1200 mm, for example, are possible. The tray grippers can therefore be better handled both during exchange and during transportation on a tool exchange carriage.

At the same time, the present invention may address problems associated with differing levels of the supply belt, removal belt and sealing tool lower part. For example, in one embodiment of the present invention, the first tray gripper needs only to be adjusted with respect to the supply belt and the sealing tool lower part, and the second tray gripper needs only to be adjusted with respect to the sealing tool lower part and the removal belt.

The first and the second tray gripper may each be attachable to the coupling device of the gripper arm by way of a first and a second holding element. This may permit connection of the tray gripper to the gripper arm without play and in a torsion-resistant manner. Preferably, this attachment is carried out without a wrench.

In one embodiment of the present invention, at least one holding element is adjustable at the tray gripper in such a manner that the tray gripper can be oriented with respect to a first, a second and/or a third transport level. The tray gripper can therefore be adjusted in its orientation relative to the position of the trays. Two tray grippers arranged and interacting on both sides of a lane of successive trays can be adjusted relative to each other in such a manner that all trays to be picked up out of a group of trays are gripped with approximately the same force. The three transport levels can be oriented parallel to each other, but have different vertical distances. The first tray grippers can be oriented relative to the first and the second transport level, and the second tray gripper can be oriented relative to the second and the third transport level each in an optimized manner.

In one embodiment, at least one holding element is adjustable at the tray gripper in two mutually perpendicular axes in such a manner in order to be able to adjust the tray gripper in a vertical plane and a horizontal plane.

The holding elements can be configured such that torques, being generated by forces acting upon the tray gripper, are absorbed by the coupling device so that the first and the second tray grippers, respectively, of a common side, together with the two corresponding tray grippers of a second opposite side, generate a symmetry of forces within the gripper device during the process of gripping and transporting the trays.

In one embodiment, two holding elements are provided for every tray gripper and interact as a two-point attachment with the coupling device of the gripper arm, preferably without play.

In another embodiment, a single holding element is provided and configured to be wedge-shaped and/or prism-shaped to allow for a connection without play of the tray gripper to the coupling device.

The first and the second tray grippers may each be connectable to their associated coupling device in an independently detachable manner.

Other and further objects of the invention, together with the features of novelty appurtenant thereto, will appear in the course of the following description.

DESCRIPTION OF THE SEVERAL VIEWS OF THE DRAWING

In the following, an advantageous embodiment of the invention is further illustrated using a drawing, where.

Same components are designated with the same reference numerals throughout the figures.

DETAILED DESCRIPTION OF THE INVENTION

Figure 1:
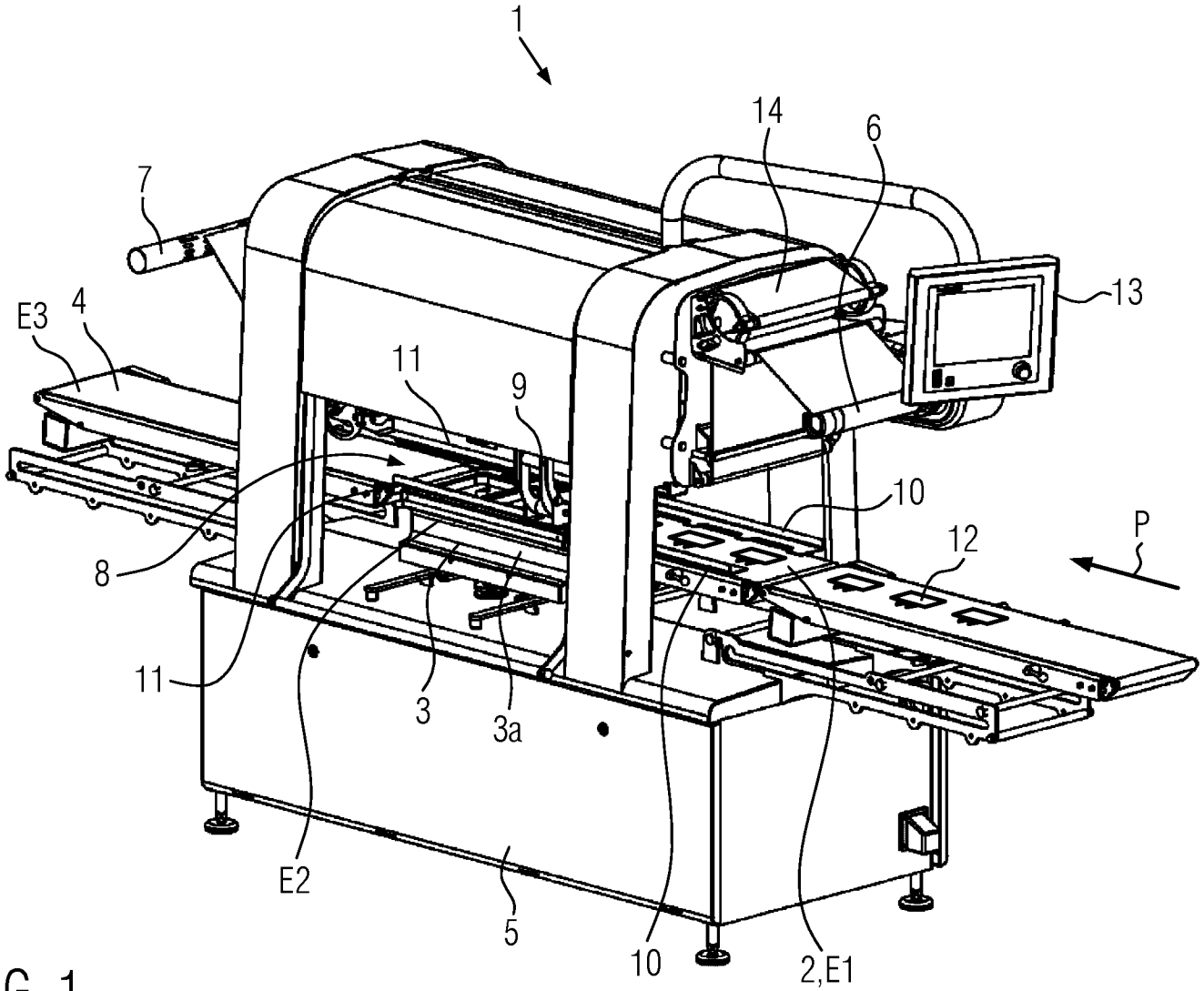
FIG. 1 is a perspective view of a tray sealer according to one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a tray sealer 1 according to one embodiment of the present invention with a supply device in the form of a supply belt 2, a sealing device 3 and a removal device in the form of a removal belt 4, which are arranged consecutively in this order in a direction of production P. Furthermore, tray sealer 1 can comprise a machine frame 5, a film feeder 6 and a film trim winder 7. A gripper device 8 with two gripper arms 9 and respectively a first 10 and a second tray gripper 11 may be provided on both sides in the direction of production P for transporting trays 12. In one embodiment, an operator can influence all processes of tray sealer 1 via an operating device 13.

During operation, trays 12 may be transported on the supply belt 2 and on the removal belt 4 into and out of the sealing device 3, respectively. In the sealing device, trays 12 are, for example, filled with a product, evacuated, flushed with gas, sealed with a top film 14 and cut. The trimmed film residue, also referred to as residual film lattice, may be wound onto film trim winder 7.

As best illustrated in FIG. 1, the upper portion of supply belt 2 forms a first transport level E1, a sealing tool lower part 3*a* of sealing device 3 for depositing trays 12 forms a second transport level E2, and the upper portion of removal belt 4 forms a third transport level E3.

Figure 2:
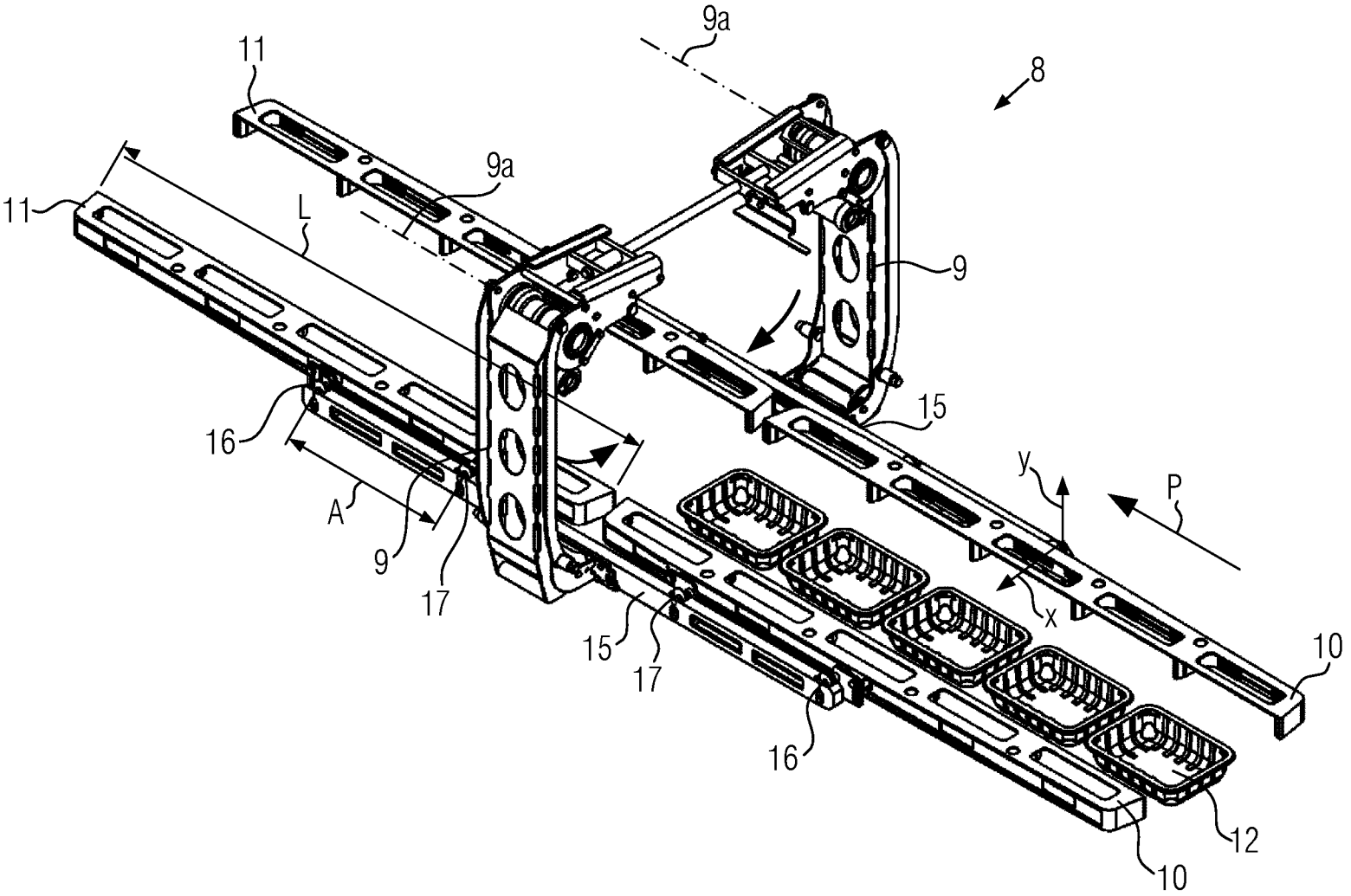
FIG. 2 is a perspective view of a gripper device according to one embodiment of the present invention.

Transfer of trays 12 between the supply belt 2, sealing device 3 and removal belt 4 can be performed by gripper device 8, which is illustrated in FIG. 2 in more detail.

FIG. 2 shows the gripper device 8 according to one embodiment of the present invention with two gripper arms 9 movable in and opposite to the direction of production P and arranged laterally relative to trays 12 to be transported. The gripper arms 9 can each comprise a coupling device 15 in their lower region. The first tray gripper 10 and the second tray gripper 11 may be respectively provided at each coupling device 15 consecutively in the direction of production P.

The two first tray grippers 10 may be configured such that they pick up between them a group of five trays 12 from supply belt 2 and transport the group to sealing device 3. The second tray grippers 11 may be at the same time be configured such that they supply the group of five trays 12, that were previously sealed with a top film 14 to a become a finished package, from the sealing device 3 to the removal belt 4.

A pivoting motion of gripper arms 9 toward each other or away from each other about pivot axes 9*a*, respectively, allows for the gripping of trays 12 from the supply belt 2 or in the sealing device 3 or for depositing trays 12 in the sealing device 3 or onto the removal belt 4.

Both first tray gripper 10, as well as second tray gripper 11, can each comprise a first 16 and a second holding element 17 by use of which tray grippers 10, 11 are attachable to and detachable from coupling device 15 without a wrench.

Figure 3:
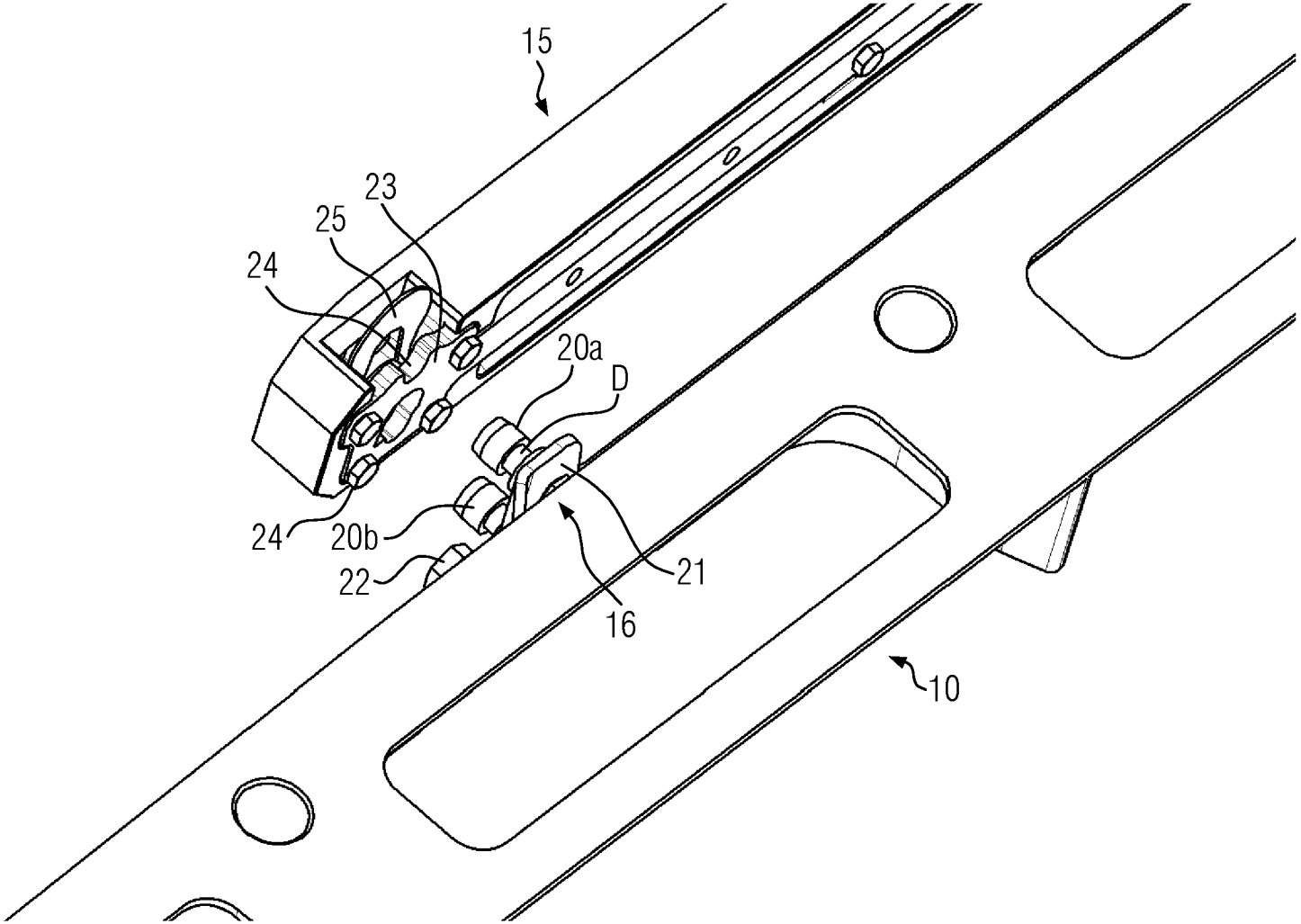
FIG. 3 is a perspective view of a coupling and a holding element according to one embodiment of the present invention.

FIG. 3 shows a detail of coupling device 15 in an enlarged view with a holding element 16 of first tray gripper 10 in a detached state. Holding element 16 can comprise two holding bolts 20*a* and 20*b* which are mounted at a fixed distance relative to each other on an adjustment plate 21. Adjustment plate 21 may be adjustably attached to tray gripper 10 by way of a bolt connection 22. Coupling device 15 can comprise a support 23 which has two U-shaped openings 24 for receiving holding bolts 20*a*, 20*b*. For this purpose, holding bolts 20*a*, 20*b* may have a reduced diameter D at their central portion which is provided for U-shaped opening 24 in a precise fit. After inserting holding bolt 20*a*, 20*b* into support 23, a spring plate 25 can ensure a reliable connection of tray gripper 10 to coupling device 15 in that spring plate 25 may enclose a holding bolt 20*a* in part and at the front end. For detaching, spring plate 25 merely has to be manually pushed away from holding bolt 20*a* so that tray gripper 10 can be removed.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. Tray sealer comprising:

a gripper device with two gripper arms;

a sealing device for sealing one or more trays;

a supply device for conveying said one or more trays to the sealing device;

a removal device for conveying said one or more trays away from the sealing device after said one or more trays are sealed;

wherein each said gripper arm comprises a coupling device that is capable to receive both a first tray gripper for supplying said unsealed trays from said supply device into said sealing device, and a second tray gripper for removing said sealed trays from said sealing device to said removal device; and wherein said first tray gripper is removably coupled to said coupling device using at least a first holding element and said second tray gripper is removably coupled to said coupling device using at least a second holding element and wherein said first tray gripper and said second tray gripper are independently removable from said coupling device.

2. Tray sealer according to claim 1, wherein said first holding element comprises a first holding bolt and a second holding bolt which are mounted on a first adjustment plate and disposed at a fixed relative distance, and the second holding element comprises a third holding bolt and a fourth holding bolt which are mounted on a second adjustment plate and disposed at a fixed relative distance.

3. Tray sealer according to claim 2, wherein the first adjustment plate is adjustably mounted to said first tray gripper, and the second adjustment plate is adjustably mounted to said second tray gripper.

4. The tray sealer according to claim 2, wherein the first adjustment plate is adjustably coupled to said first tray gripper to provide adjustment of a position of said first adjustment plate relative to said first tray gripper in at least one of a vertical and a horizontal direction, and the second adjustment plate is adjustably coupled to said second tray gripper to provide adjustment of a position of said second adjustment plate relative to said second tray gripper in at least one of the vertical direction and the horizontal direction.

5. Tray sealer according to claim 2, wherein the coupling device further comprises a first support having a first u-shaped opening for receiving the first holding bolt, and a second u-shaped opening for receiving the second holding bolt; and a second support having a third u-shaped opening for receiving the third holding bolt, and a fourth u-shaped opening for receiving the fourth holding bolt.

6. Tray sealer according to claim 1, wherein the coupling device further includes a first support for receiving the first holding element, and a second support capable to receive the second holding element.

7. Tray sealer according to claim 1, wherein the first holding element has a wedge-shape and said second holding element has a wedge shape so as to provide a connection without play.

8. Tray sealer according to claim 1, wherein the first holding element has a prism-shape and said second holding element has a prism-shape so as to provide a connection without play.

* * * * *